US007755569B2

(12) United States Patent
Wang et al.

(10) Patent No.: US 7,755,569 B2
(45) Date of Patent: Jul. 13, 2010

(54) METHOD FOR ADJUSTING THE VISUAL QUALITIES OF IMAGES DISPLAYED ON A MONITOR AND RELATED MONITOR

(75) Inventors: Chun-Fu Wang, Tainan County (TW); Min-Nan Hsieh, Tainan County (TW)

(73) Assignees: Chi Mei El Corporation, Tainan County (TW); Chimei Innolux Corporation, Chu-Nan, Miao-Li County (TW)

( * ) Notice: Subject to any disclaimer, the term of this patent is extended or adjusted under 35 U.S.C. 154(b) by 798 days.

(21) Appl. No.: 11/381,748

(22) Filed: May 5, 2006

(65) Prior Publication Data

US 2007/0045549 A1 Mar. 1, 2007

(30) Foreign Application Priority Data

Aug. 30, 2005 (TW) ..... 94129676
Mar. 1, 2006 (TW) ..... 95106868

(51) Int. Cl.
*G09G 5/00* (2006.01)

(52) U.S. Cl. ..... 345/3.3; 345/698

(58) Field of Classification Search ..... 345/3.1–3.4, 345/76–83, 88, 89, 73, 613, 690, 694–696, 345/698–699

See application file for complete search history.

(56) References Cited

U.S. PATENT DOCUMENTS 6,608,632 B2 * 8/2003 Daly et al. ..... 345/698
6,775,420 B2 * 8/2004 Daly ..... 382/275
6,807,319 B2 * 10/2004 Kovvuri et al. ..... 382/275
6,992,645 B2 * 1/2006 Kim et al. ..... 345/66
7,027,013 B2 * 4/2006 Ouellete et al. ..... 345/76
7,035,476 B2 * 4/2006 Daly ..... 382/275
7,110,012 B2 * 9/2006 Messing et al. ..... 345/698
2002/0060689 A1 * 5/2002 Iwata et al. ..... 345/612
2002/0126074 A1 * 9/2002 Ouellette et al. ..... 345/87
2002/0180768 A1 * 12/2002 Lam ..... 345/698
2003/0006953 A1 * 1/2003 Yang et al. ..... 345/90
2004/0061710 A1 * 4/2004 Messing et al. ..... 345/698
2004/0150651 A1 * 8/2004 Phan ..... 345/589
2004/0234163 A1 * 11/2004 Lee et al. ..... 382/298
2005/0128224 A1 * 6/2005 Baek et al. ..... 345/690
2005/0151752 A1 * 7/2005 Phan ..... 345/589

* cited by examiner

*Primary Examiner*—Amare Mengistu
*Assistant Examiner*—Dmitriy Bolotin
(74) *Attorney, Agent, or Firm*—Winston Hsu

(57) ABSTRACT

A method is provided. The method includes displaying a first image pixel on a first display pixel of a plurality of display pixels of a monitor, and displaying a second image pixel following the first image pixel on a portion of sub-pixels of the first display pixel and a portion of sub-pixels of a second display pixel so as to avoid loss of image data when displaying the image pixels on a monitor of a small resolution.

16 Claims, 14 Drawing Sheets

METHOD FOR ADJUSTING THE VISUAL QUALITIES OF IMAGES DISPLAYED ON A MONITOR AND RELATED MONITOR

BACKGROUND OF THE INVENTION

1. Field of the Invention

The present invention relates to a monitor, and more particularly, to a method for adjusting the visual qualities of images displayed on a monitor.

2. Description of the Prior Art

Organic light emitting diodes (OLEDs) are a branch of modern monitor technologies. The light emitting theory is different from conventional monitor technologies such as cathode ray tube (CRT), liquid crystal display (LCD), plasma display panel (PDP), field emission display (FED), liquid crystal on silicon (LCOS). OLEDs utilize organic materials to construct an LED component and have the characteristics of self light emitting. As the development of OLEDs advances, the OLED technology is extensively utilized with monitor products. Because OLEDs themself emit light, the parts used in the manufacturing of OLEDs can be reduced, and therefore reduces costs. Thus, the OLED technology is suitable for next generation monitors.

The manufacturing conditions and the precision of the machinery utilized in the process of manufacturing flat-screen monitors are limited. As a result, the monitor resolution cannot be high. Take the OLEDs as an example, in the process of manufacturing OLED products, organic films are usually formed by the method of vapor evaporation deposition. This process requires a metal shield mask. The metal shield mask is different from the photo mask used in semiconductor technology as known to those skilled in the art. As the precision of the metal shield mask cannot be compared to that of the photo mask, the resolution of the OLED products cannot be high. For example, the current technology can only produce 120-150 display pixels per inch (i.e., 120-150 ppi); hence, the competitiveness of the OLED products is lowered due to its picture resolution specification.

The conventional image display method displays image signals on a monitor with the same resolution. Please refer to FIG. 1. The right half of FIG. 1 represents an image signal 12, and the left half of FIG. 1 represents a monitor 10 having a corresponding resolution. The image signal 12 is transmitted to the monitor 10 through an electronic system. For example, when the resolution of the monitor 10 is n*m the monitor 10 will include $n^{th}$ display pixel rows, and each display pixel row includes m*3 display sub-pixels, wherein "*3" represents each display pixel having display sub-pixels of three basic colors red (R), green (G), and blue (B). The electronic system is required to transmit each image, which is the image signal 12 (including n*m*3 data), in a one-by-one manner to display the image on the display pixels of the monitor 10. As illustrated in FIG. 1, a first, a second, a third, and a fourth image pixel of a first image pixel row of the image signal 12 is respectively displayed on a first, a second, a third, and a fourth display pixel of a first display pixel row of the monitor 10. In general, an $n^{th}$ image pixel row of the image signal 12 is displayed on an $n^{th}$ display pixel row of the monitor 10. Therefore the ratio of the resolution of the monitor 10 to that of the image signal 12 is 1:1.

However, as the application of monitors has progressed, the information volume presented via the monitors has also increased. Hence, the demands for better monitors have also increased. This is especially true of the demand placed on image resolution. Demand for improved image resolution indicates that display pixels required by the monitor must be increased. Therefore the gap between each display pixel becomes narrower, and the manufacture feasibility and yield of high-resolution flat-screen monitors are reduced.

Please refer to FIG. 2, where the right half of FIG. 2 represents an image signal 12, and the left half of FIG. 2 represents another monitor 20. The resolution of the monitor 20 does not equal to that of the image signal 12. In FIG. 2, resolution of the monitor 20 is n*m/6. In other words, the monitor 20 includes $(n/2)^{th}$ horizontal display pixel rows, and each display pixel row includes (m/3)*3 display sub-pixels. Here "*3" also represents each display pixel having display sub-pixels of three basic colors: red (R), green (G), and blue (B). Note that the resolution of the monitor 20 is one-sixth that of the monitor 10, therefore, the n*m*3 data of the image signal 12 cannot be displayed correspondingly in a one-to-one manner on the display pixels of the monitor 20. On the contrary, only a portion of the image signal 12 can be displayed correspondingly on the display pixels of the monitor 20. As illustrated in FIG. 2, in an actual display period (illustrated in FIG. 6), a first and a fourth image pixel of a first image pixel row of the image signal 12 can be respectively displayed on a first and a second display pixel of a first display pixel row of the monitor 20, but a second and a third image pixel do not correspond to any display pixels of the first display pixel row of the monitor 20, therefore they are abandoned (i.e., discarded). On the other hand, an $(n-1)^{th}$ image pixel row of the image signal 12 can be displayed on an $(n/2)^{th}$ display pixel row of the monitor 20, but an $n^{th}$ image pixel row does not correspond to any display pixel row of the monitor 20, therefore they are abandoned (i.e., discarded).

SUMMARY OF THE INVENTION

The claimed invention discloses a method for adjusting visual qualities of images displayed on a monitor, the method comprises the following steps: generating a grey scale value of an image pixel row according to weight values and grey scale values of a series of image pixel rows, wherein the weight value of each image pixel row of the series of image pixel rows is greater than 0; displaying a first image pixel of the image pixel row generated in the above-mentioned step on a first display pixel of a plurality of display pixels of the monitor at a first display sub-period of a first display period; and displaying a second image pixel following the first image pixel of the image pixel row generated in the above-mentioned step on a portion of sub-pixels x1 of the first display pixel and a portion of sub-pixels y1 of a second display pixel of the plurality of display pixels at a second display sub-period of the first display period. In the present invention, a portion of sub-pixels can be one, two or more sub-pixels of the display pixel.

The claimed invention further discloses a method for adjusting visual qualities of images displayed on a monitor, the method comprises the following steps: generating a grey scale value of an image pixel row according to weight values and grey scale values of a series of image pixel rows; and displaying the image pixel row generated in the above-mentioned step on a display pixel row of the monitor; wherein the weight value of each image pixel row of the series of image pixel rows is greater than 0.

The claimed invention further discloses another method for adjusting visual qualities of images displayed on a monitor, the method comprises the following steps: displaying a first image pixel on a first display pixel of a plurality of display pixels of the monitor at a first display sub-period of a first display period; displaying a second image pixel following the first image pixel on a portion of sub-pixels x1 of the first display pixel and a portion of sub-pixels y1 of a second display pixel of the plurality of display pixels at a second display sub-period of the first display period; displaying a third image pixel following the second image pixel on a portion of sub-pixels x2 of the portion of sub-pixels x1 of the first display pixel, the portion of sub-pixels y1 of the second display pixel, and a portion of sub-pixels y2 of the second display pixel other than the portion of sub-pixels y1 of the second display pixel; and displaying corresponding image pixels at a second display period following the first display period, wherein a display sequence of display sub-periods of the second display period is opposite to a display sequence of the display sub-periods of the first display period.

The claimed invention discloses a monitor comprising a display panel, a receiving unit, and a control unit. The display panel comprises a plurality of display pixels, each display pixel comprises a plurality of display sub-pixels; the receiving unit for receiving an image signal, the image signal comprises a plurality of image pixel rows, each image pixel row comprises a plurality of image pixels, each image pixel comprises a plurality of image sub-pixels corresponding to display sub-pixels; and a control unit for displaying an image pixel of the image signal received by the receiving unit on the display panel by mapping the image sub-pixel to the corresponding display sub-pixel.

These and other objectives of the present invention will no doubt become obvious to those of ordinary skill in the art after reading the following detailed description of the preferred embodiment that is illustrated in the various figures and drawings.

DETAILED DESCRIPTION

The method and related monitor of the present invention utilize a plurality of display sub-pixels to display a plurality of sub-pixels of an image signal onto the monitor to adjust the visual qualities of images displayed on the monitor.

Figure 1:
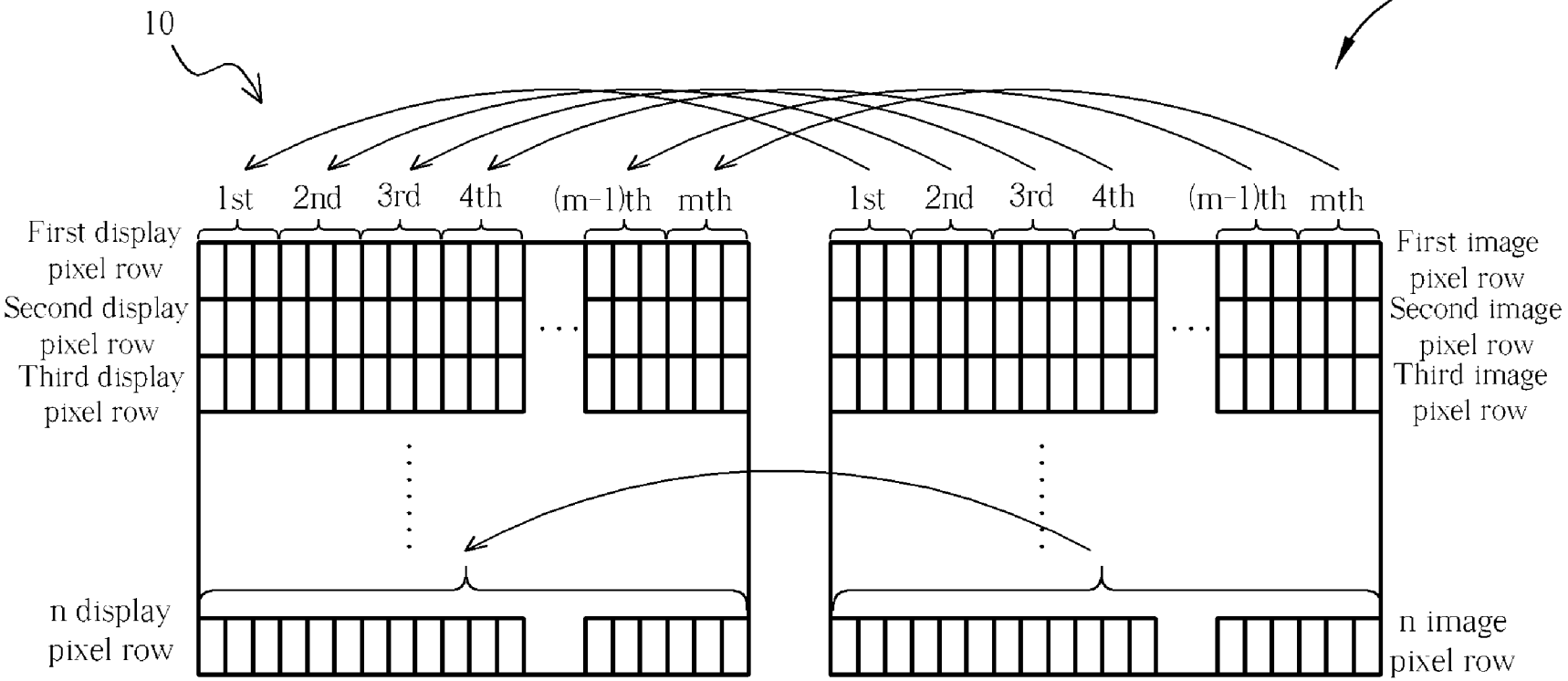
Fig. 1 Prior Art
FIG. 1 illustrates a diagram of an image signal and a resolution corresponding to a conventional monitor.
Figure 2:
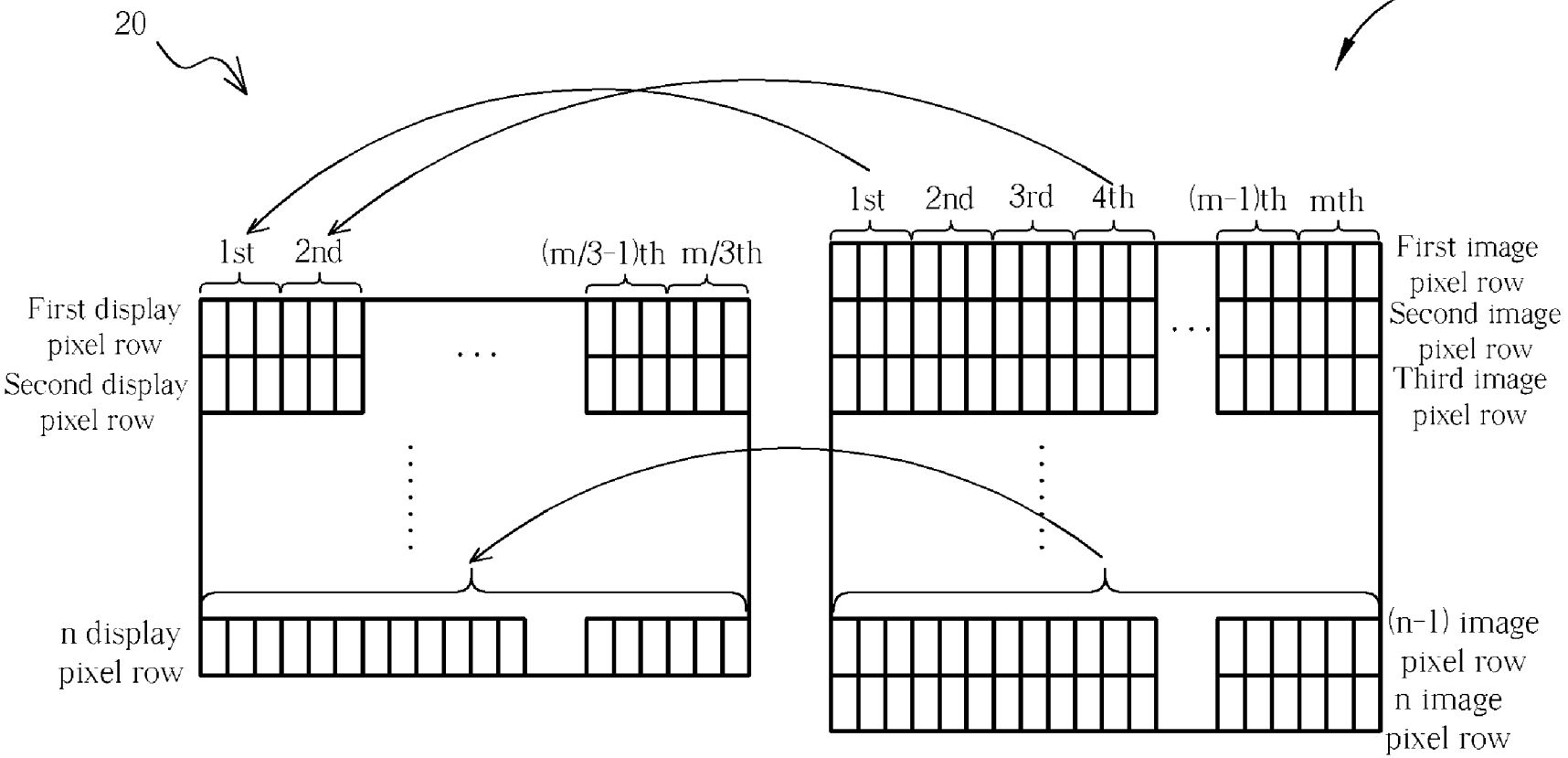
Fig. 2 Prior Art
FIG. 2 illustrates a diagram of the image signal of FIG. 1 and a conventional non-corresponding resolution monitor.
Figure 3:
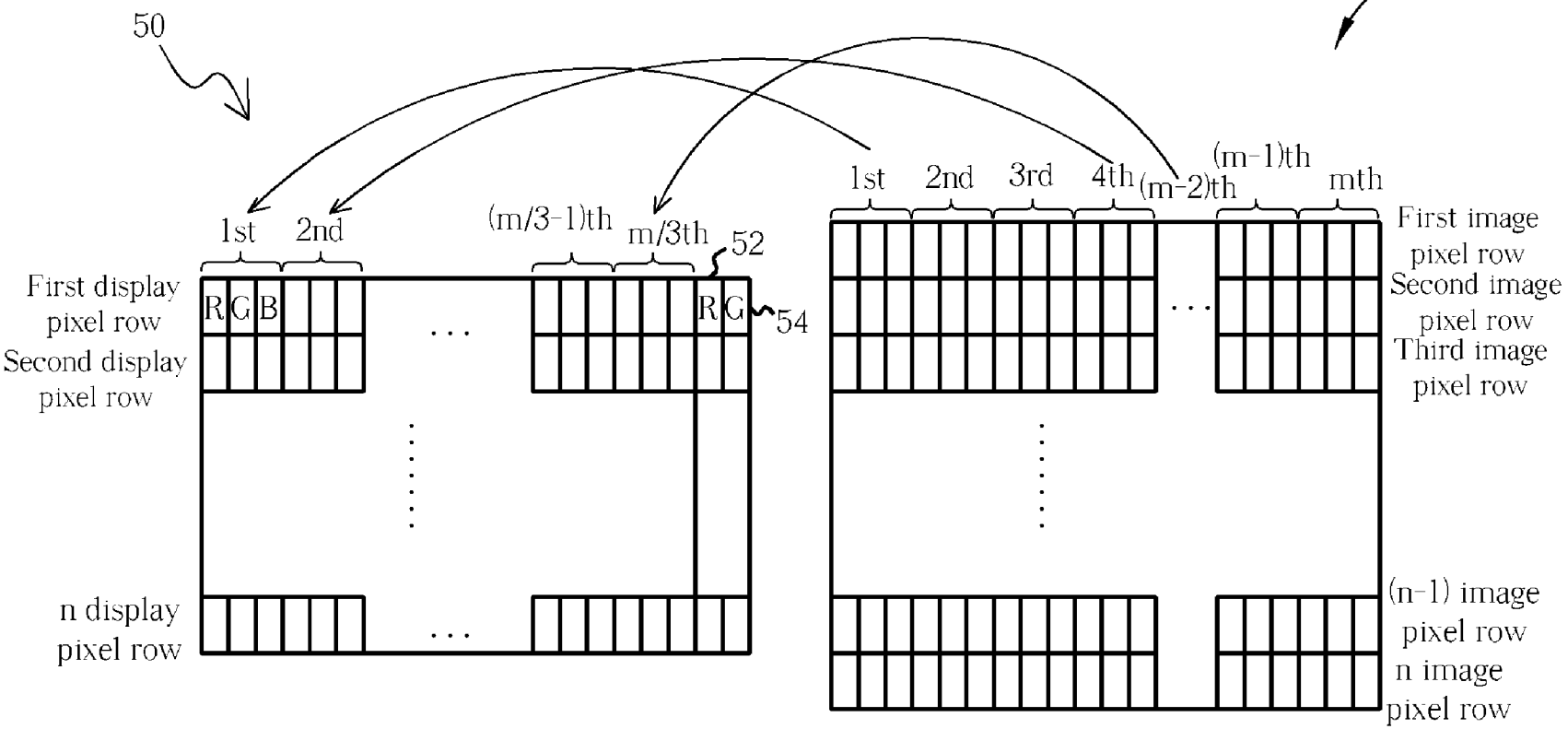
FIG. 3 through FIG. 5 illustrates diagrams of an image signal and a monitor of a first embodiment according to the present invention.
Figure 4:
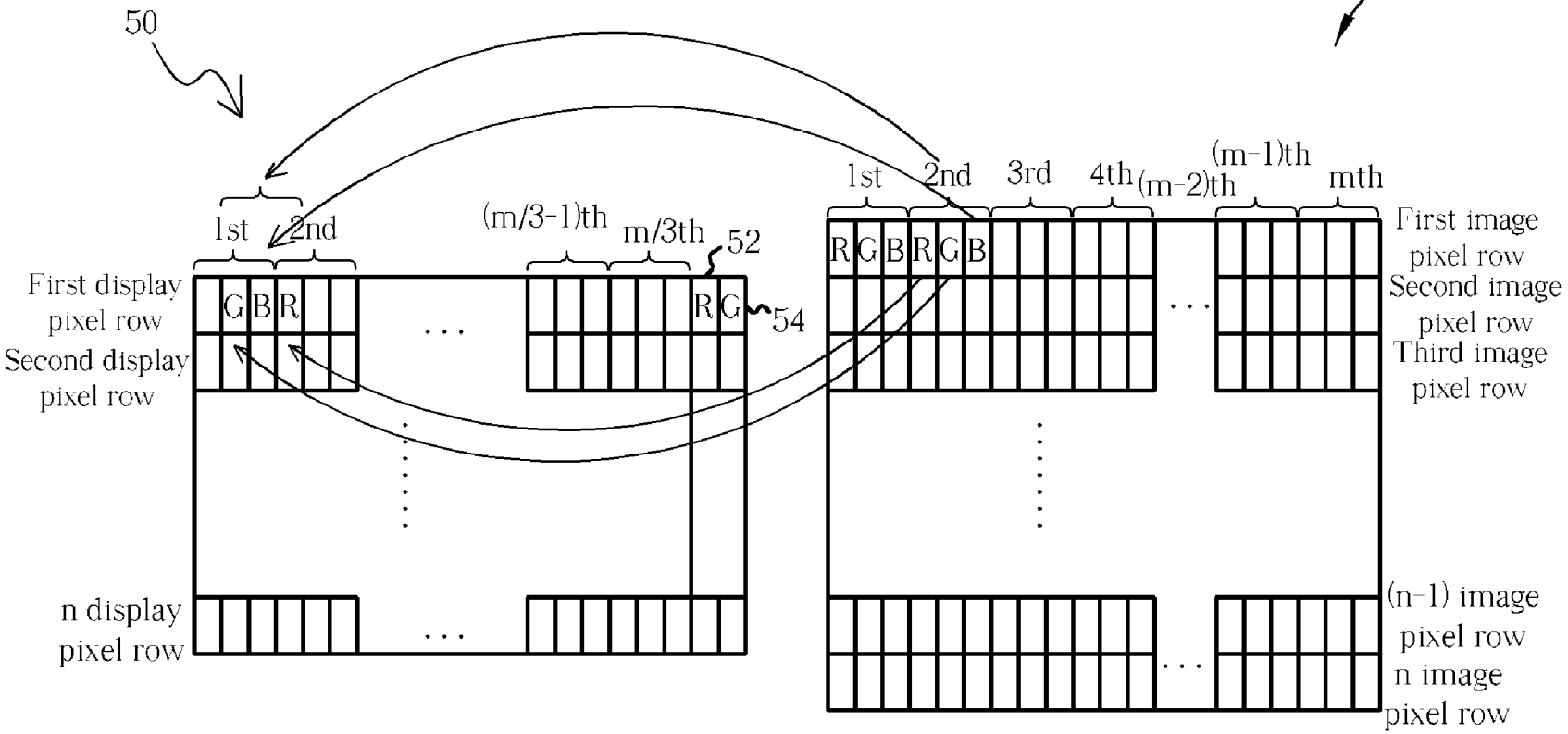
Figure 5:
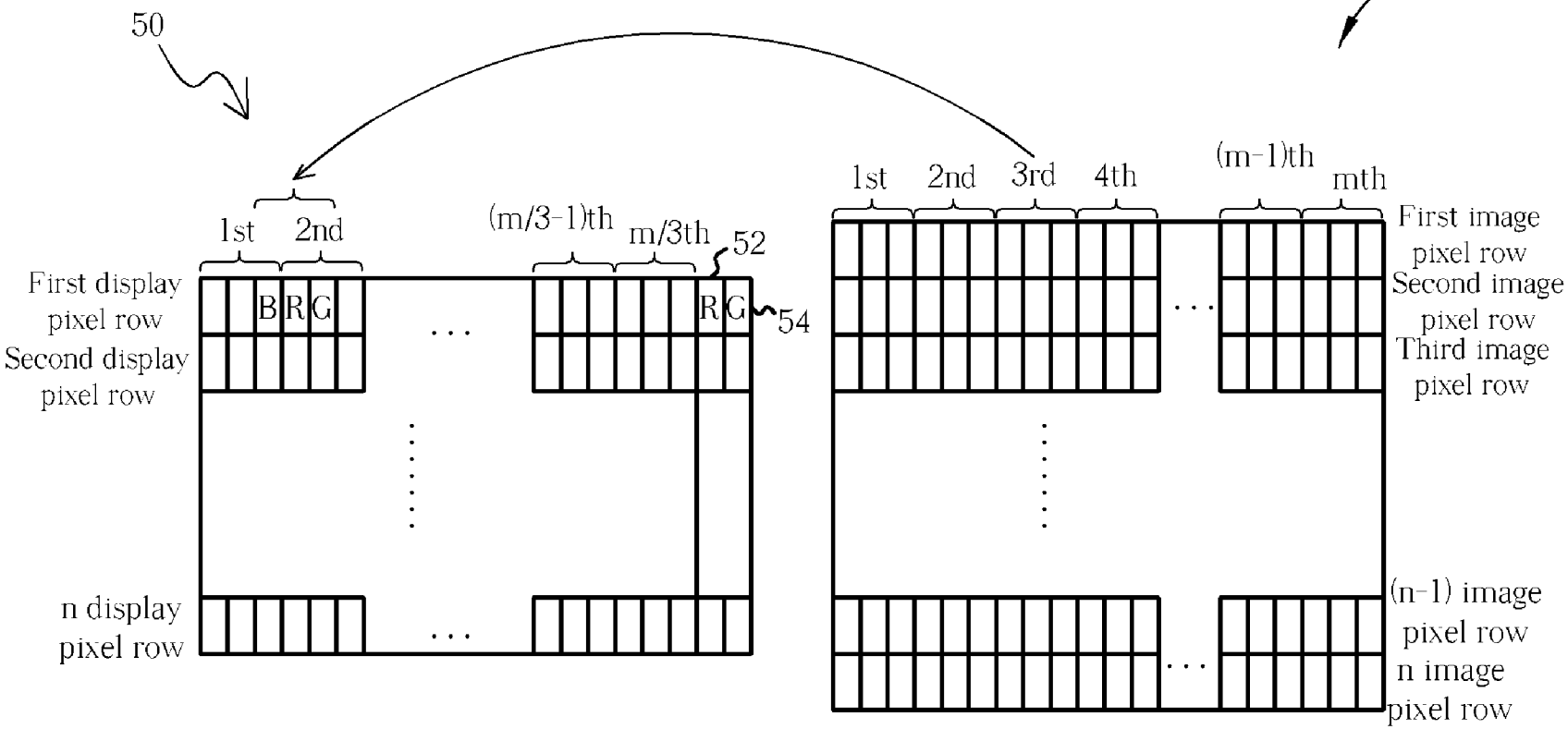
Figure 6:
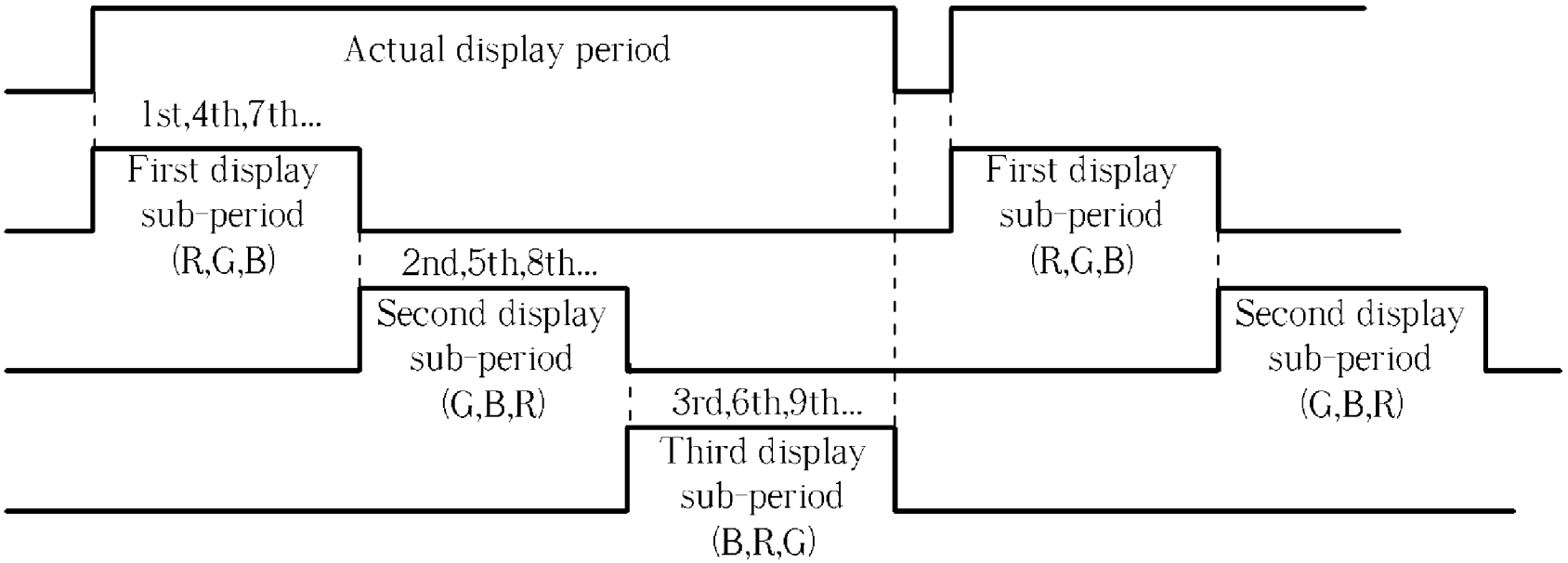
FIG. 6 illustrates an operating time diagram of the monitor.

Please refer to FIG. 3 through FIG. 6. FIG. 3 through FIG. 5 illustrates diagrams of an image signal 12 and a monitor 50 of a first embodiment according to the present invention. FIG. 6 illustrates a timing chart of display sub-periods of the monitor 50 according to the present invention. The monitor 50 includes n horizontal display pixel rows, and each display pixel of the monitor 50 includes (m/3)*3 display sub-pixels. It further includes a red (R) display sub-pixel 52, and a green (G) display sub-pixel 54. This is in contrast to the conventional monitor 20, which only includes (m/3)*3 display sub-pixels. Similarly, each display pixel of the monitor 50 also includes display sub-pixels of three basic colors: red (R), green (G), and blue (B).

Figure 12:
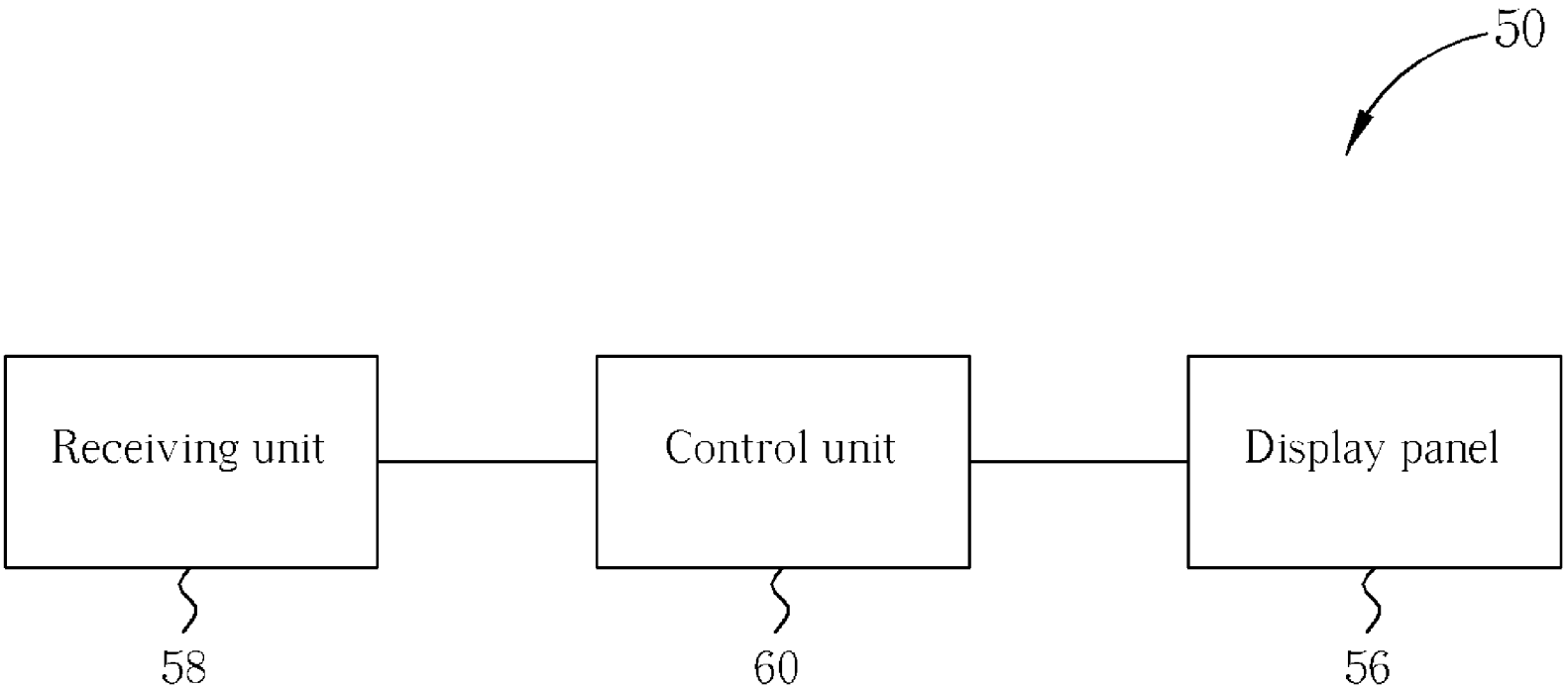
FIG. 12 illustrates a functional block diagram of a monitor according to the present invention.

In the first embodiment of the present invention, the monitor 50 includes a display panel 56, a receiving unit 58, and a control unit 60. FIG. 12 illustrates a functional block diagram of the monitor 50. The display panel 56 includes nth display pixel rows, each display pixel row includes m/3 display pixels and two additional display sub-pixels. Each display pixel includes three display sub-pixels; the receiving unit 58 is utilized for receiving an image signal 12, the image signal 12 includes $n^{th}$ image pixel rows. Each image pixel row includes $m^{th}$ image pixels. Each image pixel includes three image sub-pixels; the control unit 60 is utilized for displaying each image pixel of the image signal received by the receiving unit 58 on the display panel 56 in a sub-pixel by sub-pixel manner.

The operation of the monitor 50 is explained in the following section. At a first display sub-period (where the first sub-period is about one third of the display period), a first image pixel of a first image pixel row of the image signal 12 is still being displayed on a first display pixel of a first display pixel row of the monitor 50. In other words, image sub-pixels R, G, and B of the first image pixel of the first image pixel row of the image signal 12 are respectively displayed on R, G, and B sub-pixels of the first display pixel of the first display pixel row of the monitor 50 as illustrated in FIG. 3. At a second display sub-period (where the second sub-period is about one third of the display period), a second image pixel of the first image pixel row of the image signal 12 is displayed on the G, B display sub-pixels of the first display pixel and an R display sub-pixel of a second display pixel of the first display pixel row as illustrated in FIG. 4. In other words, the G, B display sub-pixels of the first display pixel and the R display sub-pixel of the second display pixel of the first display pixel row respectively display G, B, and R image sub-pixels of the second image pixel of the first image pixel row of the image signal 12. Furthermore, at a third display sub-period (where the third sub-period is about one third of the display period), a third image pixel of the first image pixel row of the image signal 12 is displayed on the B display sub-pixel of the first display pixel and the R and a G display sub-pixels of the second display pixel of the first display pixel row as illustrated in FIG. 5.

In general, at the first display sub-period, a fourth, a seventh, . . . , and an $(m-2)^{th}$ image pixels of the first image pixel row of the image signal 12 are respectively displayed on a second, a third, . . . , and an $(m/3)^{th}$ display pixels of the first display pixel row of the monitor 50 as illustrated in FIG. 3. At the second display sub-period, a fifth, an eighth, and an $(m-1)^{th}$ image pixels of the first image pixel row of the image signal 12 are respectively displayed on the G, B display sub-pixels of the second display pixel and an R display sub-pixel of a third display pixel, G, B display sub-pixels of the third display pixel and an R display sub-pixel of a fourth display pixel, . . . , and G, B display sub-pixels of an $(m/3)^{th}$ display pixel and the additional R display sub-pixel 52 of the first display pixel row of the monitor 50. At the third display sub-period, a sixth, a ninth, . . . , and an $m^{th}$ image pixels of the first image pixel row of the image signal 12 are respectively displayed on the B display sub-pixel of the second display pixel and the R, G display sub-pixels of the third display pixel, the B display sub-pixel of the third display pixel and the R and a G display sub-pixels of a fourth display pixel, . . . , and the B display sub-pixel of the $(m/3)^{th}$ display pixel and the additional R display sub-pixel 52 and G display sub-pixel 54 of the first display pixel row of the monitor 50.

Figure 7:
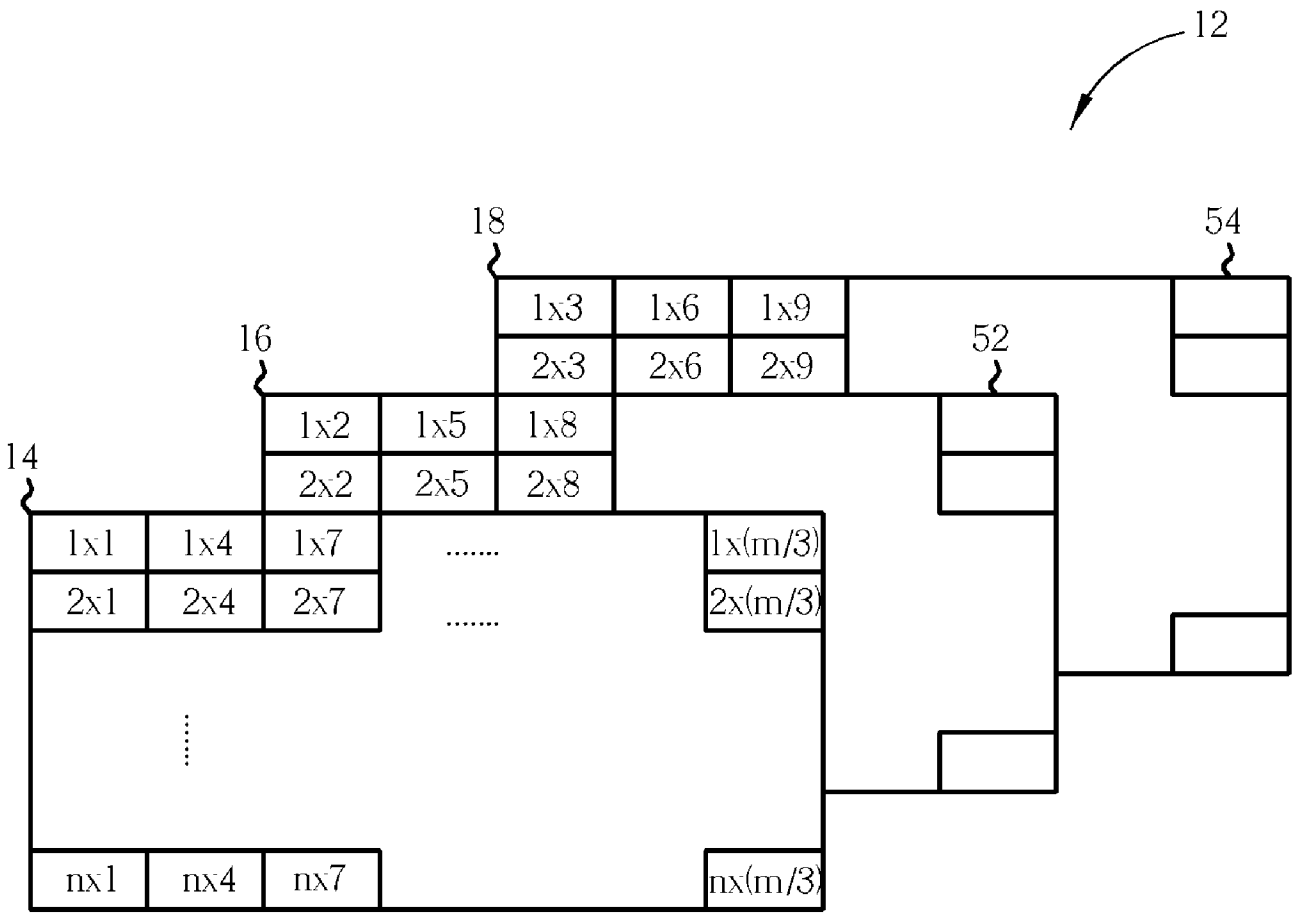
FIG. 7 illustrates a diagram of the monitor of FIG. 3 displaying the image signal of FIG. 2.

Equivalently, the image signal 12 is split into three image sub-signals: a first image sub-signal 14 includes a first, a fourth, a seventh, . . . , $(m-2)^{th}$ image pixels of each row of the image signal 12; a second image sub-signal 16 includes a second, a fifth, an eighth, . . . , $(m-1)^{th}$ image pixels of each row of the image signal 12; a third image sub-signal 18 includes a third, a sixth, a ninth, . . . , $m^{th}$ image pixels of each row of the image signal 12. The monitor 50 displays the first image sub-signal 14 of the image signal 12 at the first display sub-period, the second image sub-signal 16 at the second display sub-period, the third image sub-signal 18 at the third display sub-period as illustrated in FIG. 7. In this way, although each display pixel row of the monitor 50 includes only m/3 display pixels and two additional display sub-pixels the monitor 50 still displays each image pixel of the image signal 12 in a sub-pixel by sub-pixel manner. Equivalently, the resolution in the horizontal direction of the monitor 50 is identical to that of the image signal 12. In another words, the resolution of the monitor 50 is triple the resolution of the monitor 20, even though the number of display pixels of each display pixel row of both monitor 50 and 20 are identical.

Figure 8A:
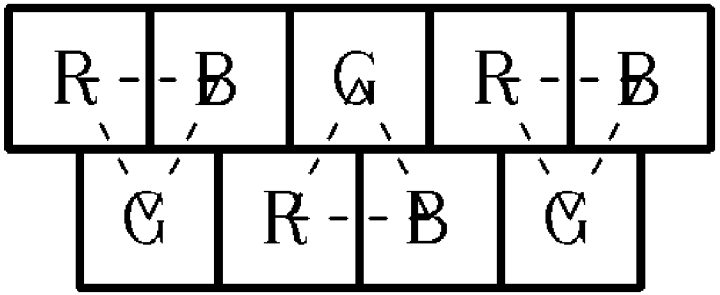
FIG. 8A, 8B and 8C illustrate diagrams of display sub-pixels of display pixel of a monitor of the present invention.
Figure 8B:
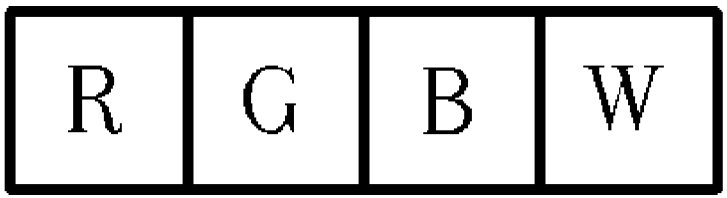
Figure 8C:
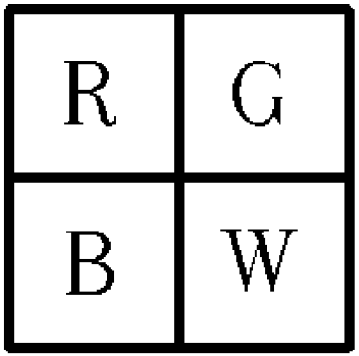

In the first embodiment of the present invention each pixel of the monitor 50 contains 3 sub-pixels, i.e. R, G, B sub-pixels, arranged in a straight line. The first pixel is red (R), the second is green (G) and the last is blue (B). However in the monitors of the present invention the pixels are not limited to contain just 3 sub-pixels. They can contain more than 3 sub-pixels. For example, besides R, G, B sub-pixels each display pixel of the monitor of the present invention can also contain a white (W) display sub-pixel. Furthermore, in the monitor of the present invention, the display sub-pixels of each display pixel are not required to be arranged in a straight-line. For example, the display sub-pixels of each display pixel of the monitor can be in a triangular arrangement with respect to each other, or can be in a straight-line or rectangular arrangement as illustrated in FIG. 8A, 8B, 8C. In FIG. 8A, each display pixel of the monitor includes 3 display sub-pixels in a triangular arrangement, in FIG. 8B, each display pixel of the monitor includes four display sub-pixels in a straight-line arrangement, and in FIG. 8C, each display pixel of the monitor includes four display sub-pixels in a rectangular arrangement.

As mentioned above the monitor of the present invention can split a display period into approximately three equal display sub-periods and display the first sub-signal 14, second sub-signal 16, and third image sub-signal 18 at respective sub-period. Furthermore, the monitor can also split the display period into three unequal display sub-periods or two equal or unequal display sub-periods. As an example, the display period can be split into two equal display sub-periods. At a first display sub-period (where the first display sub-period is half of a display period), the first image sub-signal 14 of the image signal 12 (includes a first, third, fifth, . . . , image pixels of each row of the image signal 12) is respectively displayed on the first, second, third, . . . , display pixels of each row of the monitor of the present invention. At a second display sub-period (where the second display sub-period is half of a display period), the second image sub-signal 16 of the image signal 12 (includes a second, fourth, sixth, . . . , image pixels of each row of the image signal 12) is respectively displayed on B display sub-pixel of the first display pixel and R, G display sub-pixels of the second display pixel, B display sub-pixels of the second display pixel and R, G display sub-pixels of the third display pixel, B display sub-pixels of the third display pixel and R, G display sub-pixels of the fourth display pixel, . . . , of each row of the monitor of the present invention (in the second display sub-period, the second image sub-signal 16 of the image signal 12 can also be displayed on G, B display sub-pixels of the first display pixel and R display sub-pixel of the second display pixel, G, B display sub-pixels of the second display pixel and R display sub-pixel of the third display pixel, G, B display sub-pixels of the third display pixel and R display sub-pixel of the fourth display pixel, . . . ). In this way, the ratio of the resolution of the monitor of the present invention to that of the image signal 12 is 1:2.

In the first embodiment, each row of the monitor 50 has (m/3)*3 display sub-pixels, an additional R display sub-pixel 52 and an additional G display sub-pixel 54. However the monitors of the present invention can have neither the R display sub-pixel 52 nor the G display sub-pixel 54, or they can contain just the R display sub-pixel 52. When the monitors of the present invention do not have R display sub-pixel 52 and G display sub-pixel 54, the first, fourth, seventh, . . . , and $(m-2)^{th}$ image pixels of each row of the image signal 12 are displayed on the first, second, third, . . . , and $(m/3)^{th}$ display pixels of each row of the monitors at the first display sub-period. At the second display sub-period the second, fifth, eighth, . . . , $(m-4)^{th}$ image pixels are displayed on G, B sub-pixels of the first display pixel and R sub-pixel of the second display pixel, G, B sub-pixels of the second display pixel and R sub-pixel of the third display pixel, G, B sub-pixels of the third display pixel and R sub-pixel of the fourth display pixel, . . . , G, B sub-pixels of the $[(m/3)-1]^{th}$ display pixel and R sub-pixel of the $(m/3)^{th}$ display pixel. Because the monitors do not have a R display sub-pixel 52, for $(m-1)^{th}$ image pixel, only the G, B image sub-pixels will be displayed on G, B sub-pixels of the $(m/3)^{th}$ display pixel. Similarly, for the $m^{th}$ image pixel, only the B image sub-pixel will be displayed on the B sub-pixel of the $(m/3)^{th}$ display pixel at the third display sub-period.

Please refer to FIG. 6 again. In FIG. 6, the third image sub-signal 18 at the third display sub-period is correspondingly displayed on B display sub-pixel of each display pixel and R, G display sub-pixels of a following display pixel. The first image sub-signal 14' of another image signal 12' following the image signal 12 is correspondingly displayed on R, G, B display sub-pixels of each display pixel at the first display sub-period of the following display period. However, the sequence of displaying the image sub-signals 14, 16 and 18 in the alternating display period can be altered.

Figure 9:
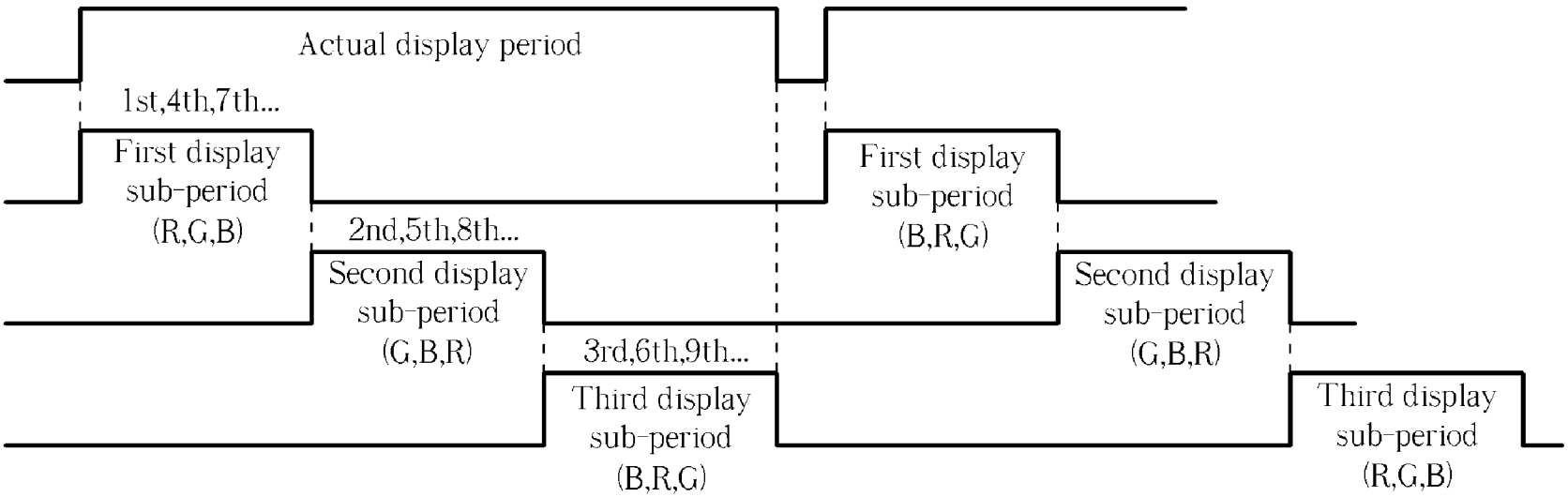
FIG. 9 illustrates an operating time diagram of a monitor according to a second embodiment of the present invention.

Please refer to FIG. 9. FIG. 9 illustrates a timing chart of display sub-periods of a monitor according to a second embodiment of the present invention. As illustrated in FIG. 9, after the third image sub-signal 18 is correspondingly displayed on B display sub-pixel of each display pixel and R, G display sub-pixels of the following display pixel at the third display sub-period, the monitor displays the other image signal 12' following the image signal 12 in an opposite image sub-signal sequence. In other words, the image sub-signal display sequence of the image signal 12' starts from the third image sub-signal 18', then the second image sub-signal 16', and last the first image sub-signal 14', wherein the third image sub-signal 18' is still correspondingly displayed on B sub-pixel of each display pixel and R, G sub-pixels of the following display pixel, the second image sub-signal 16' is displayed on G, B sub-pixels of each display pixel and R sub-pixel of the following display pixel, and the first image sub-signal 14' is displayed on each display pixel. Hence, the image signal 12 can be transformed to image 12' as smooth as possible.

The above-mentioned method can improve visual qualities of images of the monitor of the present invention in the horizontal direction. The followings explain how visual qualities of images of the monitor of the present invention can be improved in a vertical direction.

Figure 10:
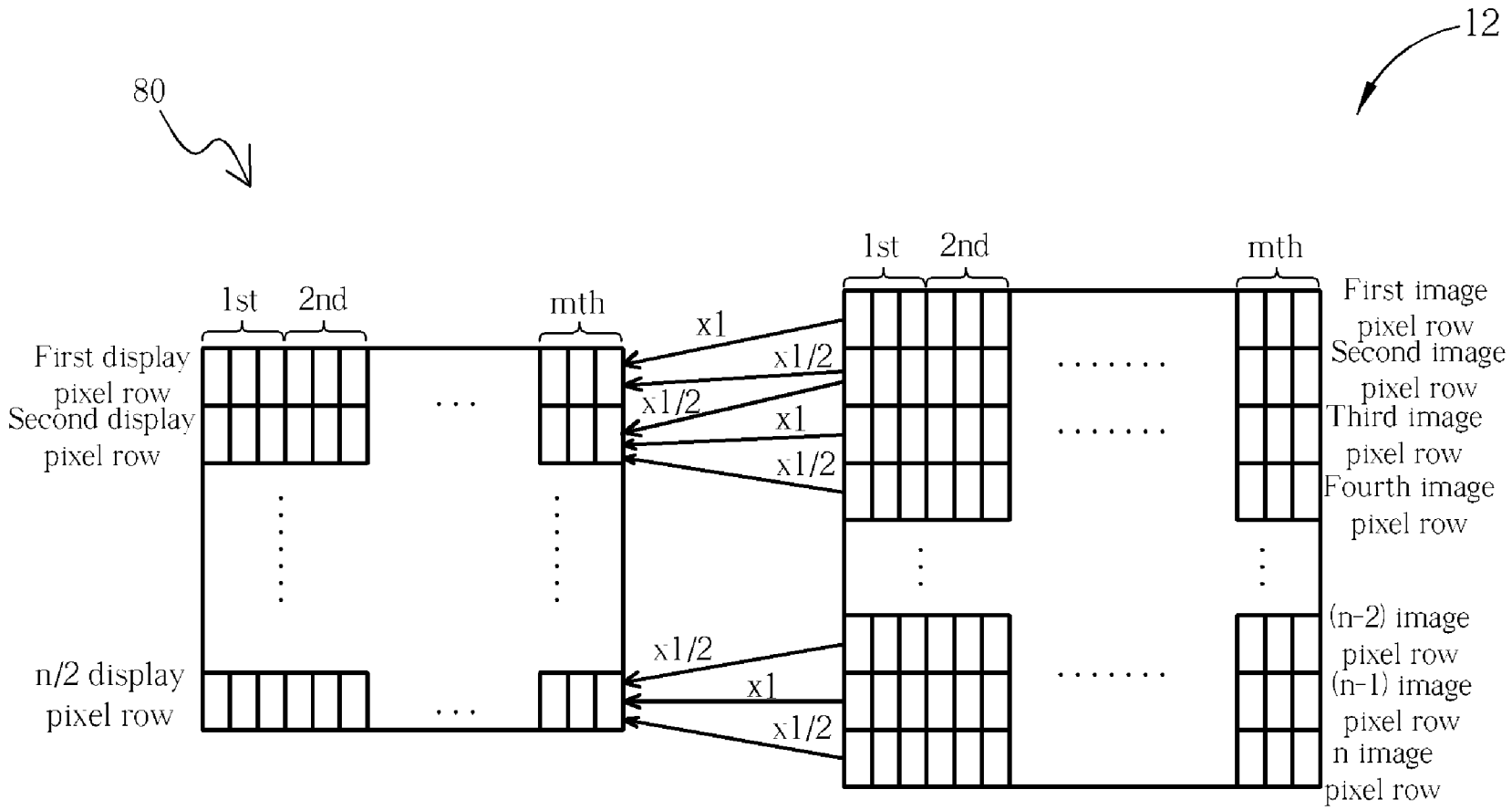
FIG. 10 illustrates a diagram of an image signal and a monitor of a third embodiment according to the present invention.

Please refer to FIG. 10. FIG. 10 illustrates a diagram of an image signal 12 and a monitor 80 of a third embodiment according to the present invention. The monitor 80 is different from the monitor 50 in that the monitor 80 only includes n/2 horizontal display pixel rows. Furthermore, for an easy explanation, each display pixel row of the monitor 80 includes m*3 display sub-pixels.

Note that the number of display pixel rows of the monitor 80 utilized for displaying the image signal 12 is only half that of the image pixel rows of the image signal 12. Therefore in order to prevent losing any image pixel row data of the image signal 12, in the third embodiment of the present invention, image pixel rows of the image signal 12 that cannot correspond to display pixel rows of the monitor 80 will be equally displayed on the display pixel rows of the monitor 80.

The operation of the monitor 80 is explained in the following section. Because the second image pixel row of the image signal has no corresponding display pixel row on the monitor 80 of the third embodiment of the present invention, half signal of the second image pixel row of the image signal 12 is displayed on a first display pixel row of the monitor 80 (the first display pixel row of the monitor 80 corresponds to the first image pixel row of the image signal 12). The other half signal of the second image pixel row of the image signal 12 is displayed on the second display pixel row of the monitor 80 (the second display pixel row of the monitor 80 corresponds to the third image pixel row (3=2*2−1) of the image signal 12). The first display pixel row of the monitor 80 is required to display the first image pixel row of the image signal 12, and it is also required to display half signal of the second image pixel row of the image signal 12. In order to normalize brightness of the image signal 12 displayed on the monitor 80, the first display pixel row of the monitor 80 displays: (signal of the first image pixel row of the image signal 12*1+signal of the second image pixel row of the image signal 12*½)/(1+½)).

To continue, the other half signal of the remaining second image pixel of the image signal 12 is displayed on the second display pixel row of the monitor 80. The second display pixel row of the monitor 80 further displays the corresponding third image pixel row of the image signal 12, and half signal of the fourth image pixel row of the image signal 12. Similarly, in order to normalize brightness of the image signal 12 displayed on the monitor 80, the second display pixel row of the monitor 80 displays: (signal of the second image pixel row of the image signal 12*½+signal of the third image pixel row of the image signal 12*1+signal of the fourth image pixel row of the image signal 12*½)/(½+1+½)). In general, a $k^{th}$ display pixel row of the monitor 80 correspondingly displays the $(k*2-1)^{th}$ image pixel row of the image signal 12, and also displays half signal of the $(k*2-2)^{th}$ image pixel row (a previous image pixel row of the $(k*2-1)^{th}$ image pixel) of the image signal 12, and half signal of the $(k*2)^{th}$ image pixel row (a next image pixel row of the $(k*2-1)^{th}$ image pixel row) of the image signal 12 and so forth. Similarly, in order to normalize brightness of the image signal 12 displayed on the monitor 80, the $k^{th}$ display pixel row of the monitor 80 displays: (signal of the $(k*2-2)^{th}$ image pixel row of the image signal 12*½+signal of the $(k*2-1)^{th}$ image pixel row of the image signal 12*1+signal of the $(k*2)^{th}$ image pixel row of the image signal 12*½)/(½+1+½)). At last, the $(n/2)^{th}$ display pixel row of the monitor 80 correspondingly displays the $(n/2*2-1)^{th}$ image pixel row of the image signal 12, and also displays half signal of the $(n/2*2-2)^{th}$ image pixel row and half signal of the $(n/2*2)^{th}$ image pixel row of the image signal 12. Similarly, in order to normalize brightness of the image signal 12 displayed on the monitor 80, $(n/2)^{th}$ display pixel row of the monitor 80 displays: (signal of the $(n-2)^{th}$ image pixel row of the image signal 12*½+signal of the $(n-1)^{th}$ image pixel row of the image signal 12*1+signal of the $n^{th}$ image pixel row of the image signal 12*½)/(½+1+½)).

According to the image pixel row weighted method mentioned previously, the monitor 80 utilizes almost all the image signal 12 during display in spite that the number of display pixel rows of the monitor 80 only include half the number of image pixel rows of the image signal 12. Although the ratio of the (vertical) resolution of the monitor 80 to that of the image signal 12 is 1:2, the visual qualities of images displayed on the monitor 80 is improved by the weighted method.

In the third embodiment according to the present invention, the $k^{th}$ display pixel row corresponds to the $(2*k-1)^{th}$ image pixel row of the image signal 12. Alternatively the $k^{th}$ display pixel row of the monitor 80 can correspond other image pixel rows of the image signal 12.

Figure 11:
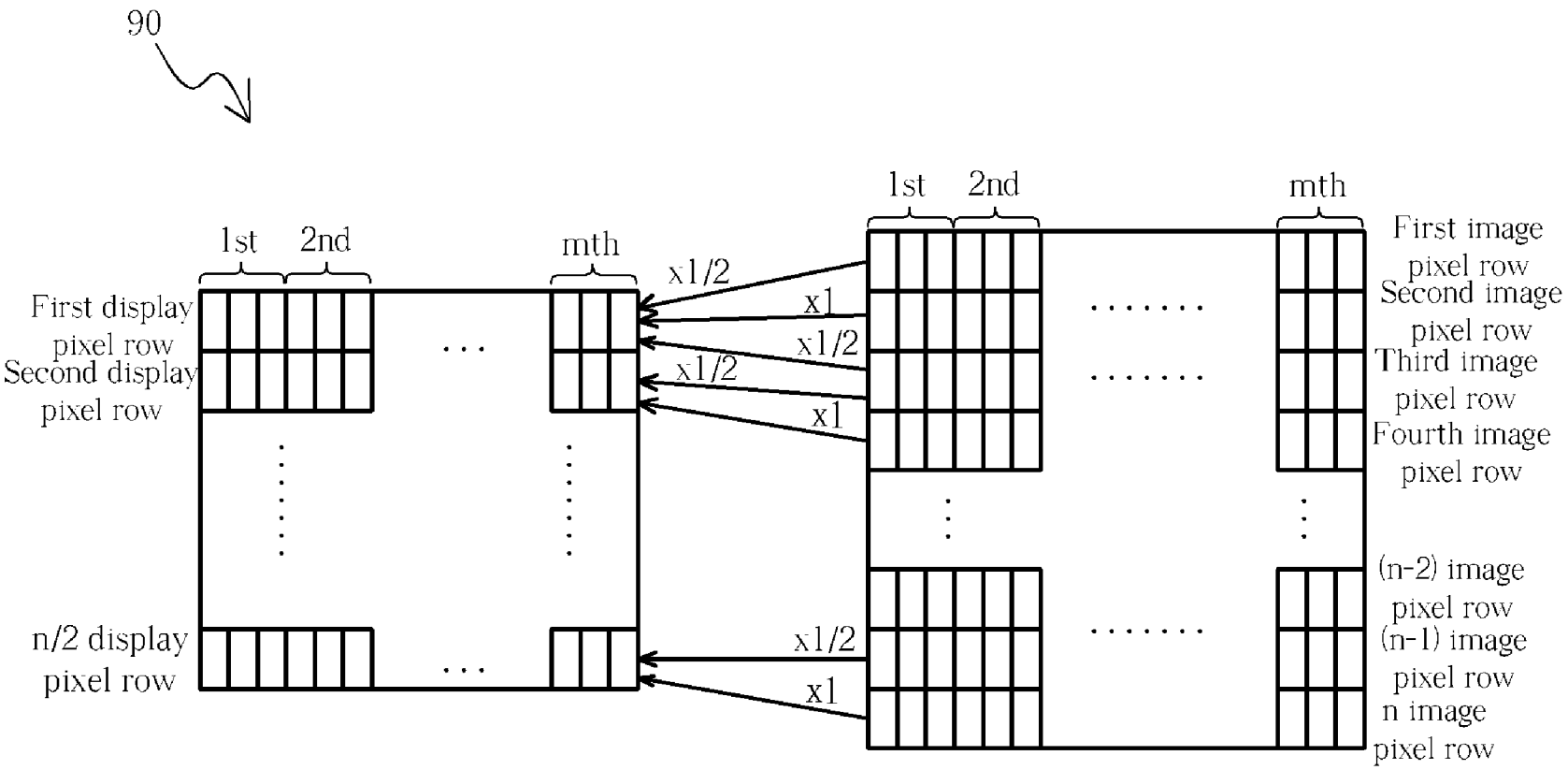
FIG. 11 illustrates a diagram of the image signal and a monitor of a fourth embodiment according to the present invention.

Please refer to FIG. 11. FIG. 11 illustrates a diagram of the image signal 12 and a monitor 90 of a fourth embodiment according to the present invention. The monitor 90 also includes n/2 horizontal display pixel rows. Furthermore, for an easy explanation, each display pixel row of the monitor 90 also includes m*3 display sub-pixels.

Because the number of display pixel rows of the monitor 90 utilized for displaying the image is only half that of the image pixel rows of the image signal 12, therefore in order to prevent losing any image pixel row data of the image signal 12, in the fourth embodiment, image pixel rows of the image signal 12 that cannot correspond to the display pixel rows of the monitor 90 will be equally displayed on the display pixel rows of the monitor 90.

The operation of the monitor 90 is explained in the following section. Because the first image pixel row and the third image pixel row of the image signal 12 have no corresponding display pixel row on the monitor 90, therefore, in the fourth embodiment of the present invention, half signal of the first image pixel row and half signal of the third image pixel row of the image signal 12 are displayed on a first display pixel row of the monitor 90. The first display pixel row of the monitor 90 corresponds to the second image pixel row (2=1*2) of the image signal 12. In order to normalize brightness of the image signal 12 displayed on the monitor 90, the first display pixel row of the monitor 90 displays: (signal of the first image pixel row of the image signal 12*½+signal of the second image pixel row of the image signal 12*1+signal of the third image pixel row of the image signal 12*½)/(½+1+½)). In general, a $k^{th}$ display pixel row of the monitor 90 correspondingly displays the $(k*2)^{th}$ image pixel row of the image signal 12, and also displays half signal of the $(k*2-1)^{th}$ image pixel row (which is a previous image pixel row of the $(k*2)^{th}$ image pixel row) of the image signal 12, and half signal of the $(k*2+1)^{th}$ image pixel row (a next image pixel row of the $(k*2)^{th}$ image pixel row) of the image signal 12. Similarly, in order to normalize brightness of the image signal 12 displayed on the monitor 90, the $k^{th}$ display pixel row of the monitor 90 displays: (signal of the $(k*2-1)^{th}$ image pixel row of the image signal 12*½+signal of the $(k*2)^{th}$ image pixel row of the image signal 12*1+signal of the $(k*2+1)^{th}$ image pixel row of the image signal 12*½)/(½+1+½)). At last, the $(n/2)^{th}$ display pixel row of the monitor 90 correspondingly displays the $(n/2*2)^{th}$ image pixel row of the image signal 12, and also displays half signal of the $(n/2*2-1)^{th}$ image pixel row of the image signal 12. Similarly, in order to normalize brightness of the image signal 12 displayed on the monitor 90, the $(n/2)^{th}$ display pixel row of the monitor 90 displays: (signal of the $(n-1)^{th}$ image pixel row of the image signal 12*½+ signal of the $n^{th}$ image pixel row of the image signal 12*1)/(½+1)).

According to the image pixel row weighted method previously mentioned, the monitor 90 still utilizes almost all the image signal 12 during display in spite that the number of display pixel rows of the monitor 90 is only half that of the image signal 12. Although the (vertical) ratio of the resolution of the monitor 90 to that of the image signal 12 is 1:2, the visual qualities of images displayed on the monitor 90 can still be improved by the weighted method.

In comparison to the prior art, the present invention utilizes the display sub-period method, the image pixel row weighted method, and the pixel sharing method (which is to display a plurality of image pixels of an image signal on a monitor in a sub-pixel by sub-pixel manner) to display image without loosing any image data even though the monitor resolution is not high.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for adjusting visual qualities of images displayed on a monitor, wherein each image comprises m*n image pixels and the monitor comprises (m/3)*n display pixels and m and n are integers greater than or equal to 1, wherein each image pixel comprises a first color image sub-pixel, a second color image sub-pixel and a third color image sub-pixel, and each display pixel comprises a first color display sub-pixel, a second color display sub-pixel and a third color display sub-pixel, the method comprising following steps:

(a) generating a grey scale value of an image pixel row according to weight values and grey scale values of a series of image pixel rows, wherein the weight value of each image pixel row of the series of image pixel rows is greater than 0;

(b) respectively displaying a $(1+3i)_{th}$ image pixel of the image pixel row generated in step (a) on a $(i+1)_{th}$ display pixel of a plurality of display pixels of the monitor at a first display sub-period of a first display period, wherein i is an integer greater than or equal to 0; and (c) respectively displaying a $(2+3i)_{th}$ image pixel of the image pixel row generated in step (a) on the second and the third color display sub-pixels of the $(i+1)_{th}$ display pixel and the first color display sub-pixel of the $(i+2)_{th}$ display pixel of the plurality of display pixels.

2. The method of claim 1 further comprising (d) respectively displaying a $(3+3i)_{th}$ image pixel of the image pixel row generated in step (a) on the third color display sub-pixel of the $(i+1)_{th}$ display pixel and the first and second color display sub-pixels of the $(i+2)_{th}$ display pixel at a third display sub-period of the first display period.

3. The method of claim 2 further comprising (f) a second display period following the first display period, wherein a display sequence of display sub-periods of the second display period is opposite to a display sequence of the display sub-periods of the first display period.

4. The method of claim 1, wherein when image pixels are displayed on the display pixels of the monitor during the first display sub-period, the image pixels are displayed starting with a first sub-pixel of the display pixels, and when image pixels are displayed on the display pixels of the monitor during the second display sub-period, the image pixels are displayed starting with a second sub-pixel of the display pixels.

5. The method of claim 4, wherein during the first display sub-period, the image pixels are displayed in the order of R, G, and B sub-pixels of the display pixels, and during the second display sub-period, the image pixels are displayed in the order of G, B, and R sub-pixels of the display pixels.

6. The method of claim 2, wherein when image pixels are displayed on the display pixels of the monitor during the first display sub-period, the image pixels are displayed starting with a first sub-pixel of the display pixels, when image pixels are displayed on the display pixels of the monitor during the second display sub-period, the image pixels are displayed starting with a second sub-pixel of the display pixels, and when image pixels are displayed on the display pixels of the monitor during the third display sub-period, the image pixels are displayed starting with a third sub-pixel of the display pixels.

7. The method of claim 6, wherein during the first display sub-period, the image pixels are displayed in the order of R, G, and B sub-pixels of the display pixels, during the second display sub-period, the image pixels are displayed in the order of G, B, and R sub-pixels of the display pixels, and during the third display sub-period, the image pixels are displayed in the order of B, R, and G sub-pixels of the display pixels.

8. A monitor capable of adjusting visual qualities of images, the monitor comprising:

a display panel comprising a plurality of display pixels, wherein the monitor comprises (m/3)*n display pixels and m and n are integers greater than or equal to 1, and each display pixel comprises a first color display sub-pixel, a second color display sub-pixel and a third color display sub-pixel;

a receiving unit for receiving an image signal, the image signal comprising a series of image pixel rows, wherein each image comprises m*n image pixels, and each image pixel comprises a first color image sub-pixel, a second color image sub-pixel and a third color image sub-pixel; and a control unit for generating a grey scale value of an image pixel row according to weight values and grey scale values of the series of image pixel rows of the image signal received by the receiving unit, wherein the weight value of each image pixel row of the series of image pixel rows is greater than 0; and for respectively displaying a $(1+3i)_{th}$ image pixel of the image pixel row on a $(i+1)_{th}$ display pixel of a plurality of display pixels of the display panel at a first display sub-period of a first display period; and for respectively displaying a $(2+3i)_{th}$ image pixel of the image pixel row on the second and the third color display sub-pixels of the $(i+1)_{th}$ display pixel and the first color display sub-pixel of the $(i+2)_{th}$ display pixel of the plurality of display pixels at a second display sub-period of the first display period, wherein i is an integer greater than or equal to 0.

9. The monitor of claim 8, wherein the control unit further respectively displays a $(3+3i)_{th}$ image pixel of the image pixel row on the third color display sub-pixel of the $(i+1)_{th}$ display pixel and the first and second color display sub-pixels of the $(i+2)_{th}$ display pixel at a third display sub-period of the first display period.

10. The monitor of claim 9, wherein the control unit further displays in an opposite display sub-period sequence at a second display period following the first display period.

11. The monitor of claim 8, wherein when image pixels are displayed on the display pixels of the monitor during the first display sub-period, the image pixels are displayed starting with a first sub-pixel of the display pixels, and when image pixels are displayed on the display pixels of the monitor during the second display sub-period, the image pixels are displayed starting with a second sub-pixel of the display pixels.

12. The monitor of claim 11, wherein during the first display sub-period, the image pixels are displayed in the order of R, G, and B sub-pixels of the display pixels, and during the second display sub-period, the image pixels are displayed in the order of G, B, and R sub-pixels of the display pixels.

13. The monitor of claim 9, wherein when image pixels are displayed on the display pixels of the monitor during the first display sub-period, the image pixels are displayed starting with a first sub-pixel of the display pixels, when image pixels are displayed on the display pixels of the monitor during the second display sub-period, the image pixels are displayed starting with a second sub-pixel of the display pixels, and when image pixels are displayed on the display pixels of the monitor during the third display sub-period, the image pixels are displayed starting with a third sub-pixel of the display pixels.

14. The monitor of claim 13, wherein during the first display sub-period, the image pixels are displayed in the order of R, G, and B sub-pixels of the display pixels, during the second display sub-period, the image pixels are displayed in the order of G, B, and R sub-pixels of the display pixels, and during the third display sub-period, the image pixels are displayed in the order of B, R, and G sub-pixels of the display pixels.

15. A method for adjusting visual qualities of images displayed on a monitor, wherein each image comprises m*n image pixels and the monitor comprises (m/3)*n display pixels and m and n are integers greater than or equal to 1, wherein each image pixel comprises a first color image sub-pixel, a second color image sub-pixel and a third color image sub-pixel, and each display pixel comprises a first color display sub-pixel, a second color display sub-pixel and a third color display sub-pixel, the method comprising following steps:

(a) respectively displaying a $(1+3i)_{th}$ image pixel on a first, a second, a third, and an $(m/3)^{th}$ display pixel of a plurality of display pixels of the monitor at a first display sub-period of a first display period, wherein i is an integer greater than or equal to 0;

(b) respectively displaying a $(2+3i)_{th}$ image pixel on the second and the third color display sub-pixels of the $(i+1)_{th}$ display pixel and the first color display sub-pixel of the $(i+2)_{th}$ display pixel of the plurality of display pixels at a second display sub-period of the first display period;

(c) respectively displaying a $(3+3i)_{th}$ image pixel on the third color display sub-pixel of the $(i+1)_{th}$ display pixel and the first and second color display sub-pixels of the $(i+2)_{th}$ display pixel at a third display sub-period of the first display period; and (e) displaying corresponding image pixels at a second display period following the first display period, wherein a display sequence of display sub-periods of the second display period is opposite to a display sequence of display sub-periods of the first display period.

16. A monitor capable of adjusting visual qualities of images, the monitor comprising:

a display panel comprising a plurality of display pixel rows, each display pixel row comprising (m/3)*n display pixels and m and n are integers greater than or equal to 1, each display pixel comprising a first color display sub-pixel, a second color display sub-pixel and a third color display sub-pixel;

a receiving unit for receiving an image signal, the image signal comprising a plurality image pixel rows, each image pixel row comprising a plurality of image pixels, wherein each image comprises m*n image pixels, and each image pixel comprises a first color image sub-pixel, a second color image sub-pixel and a third color image sub-pixel; and a control unit for respectively displaying a $(1+3i)_{th}$ image pixel of the image pixel row of the image signal received by the receiving unit on a $(i+1)_{th}$ display pixel of the plurality of display pixels at a first display sub-period of a first display period; and for respectively displaying a $(2+3i)_{th}$ image pixel of the image pixel row on the second and the third color display sub-pixels of the $(i+1)_{th}$ display pixel and the first color display sub-pixel of the $(i+2)_{th}$ display pixel of the plurality of display pixels at a second display sub-period of the first display period; and respectively displaying $(3+3i)_{th}$ image pixel of the image pixel row on the third color display sub-pixel of the $(i+1)_{th}$ display pixel and the first and second color display sub-pixels of the $(i+2)_{th}$ display pixel at a third display sub-period of the first display period; displaying corresponding image pixels in an opposite display sub-period sequence at a second display period following the first display period, wherein i is an integer greater than or equal to 0.

* * * * *